US005733034A

United States Patent [19]

Jan

[11] Patent Number: 5,733,034

[45] Date of Patent: Mar. 31, 1998

[54] DRIVER STRUCTURE

[76] Inventor: John-Kai Jan, 4F, No. 5, Alley 8, Lane 197, Chung-Shan 1 Rd., Lu-Chou Hsian, Taipei Hsien, Taiwan

[21] Appl. No.: 825,707

[22] Filed: Mar. 19, 1997

[51] Int. Cl.[6] ..... B25B 23/18

[52] U.S. Cl. ..... 362/119; 362/154; 362/253

[58] Field of Search ..... 362/109, 119, 362/120, 154, 208, 253; 7/165

[56] References Cited

U.S. PATENT DOCUMENTS 3,006,395 10/1961 Dye ..... 7/165 X 3,603,782 9/1971 Wortmann ..... 362/120

5,515,249 5/1996 Shiao ..... 362/119

*Primary Examiner*—Stephen F. Husar

*Attorney, Agent, or Firm*—Bacon & Thomas

[57] ABSTRACT

An improved driver structure including a driver shell, a tool portion for mounting a tool connecting portion disposed on said driver shell, and a lighting portion with a light source. The tool portion accommodates a swivel shaft therein, the swivel shaft accommodating more than one drive bit. By turning the swivel shaft, the drive bit may be turned to an opening on the tool portion so that the drive bit may be pushed out via the opening and then fitted onto the tool connecting portion. The light source of the lighting portion provides light for working at night.

2 Claims, 3 Drawing Sheets

DRIVER STRUCTURE

BACKGROUND OF THE INVENTION

The present invention relates generally to an improved driver structure, and more particularly to a driver which is convenient to carry and serves a lighting device when working at night.

Drivers are indispensable hand tools. In the past, because of their size and weight, they were inconvenient to carry and use. Compact tool kits were later developed to contain the drivers so that they could be less inconvenient to carry. However, such tool kits could contain limited number of tools. Besides, the tools may fall out of the tool kit it is not opened with a suitable force. Therefore, reducing the size of the tool kit does not make use any more convenient.

Furthermore, existing hand tools, whether large or small, are usually not provided with any lighting means so that use of the tools has to be restricted to lighted places.

SUMMARY OF THE INVENTION

Accordingly, a primary object of the present invention is to provide an improved driver structure with lighting function so as to eliminate the drawbacks with the prior art.

Another object of the present invention is to provide a compact driver which is convenient to carry.

A further object of the present invention is to provide a driver with an interior for accommodating a driver bit therein.

DETAILED DESCRIPTION OF THE PREFERRED EMBODIMENT

Figure 1:
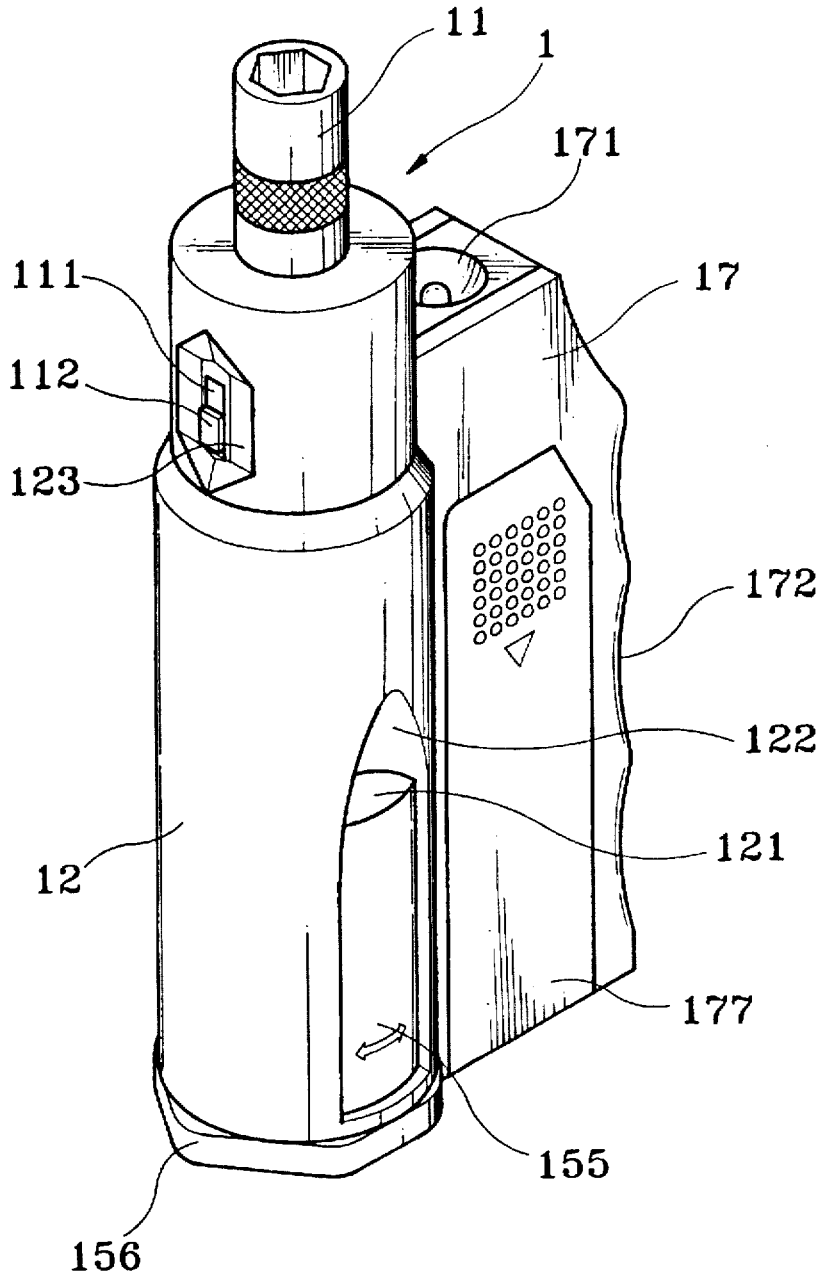
FIG. 1 is a schematic elevational view of the present invention.
Figure 2:
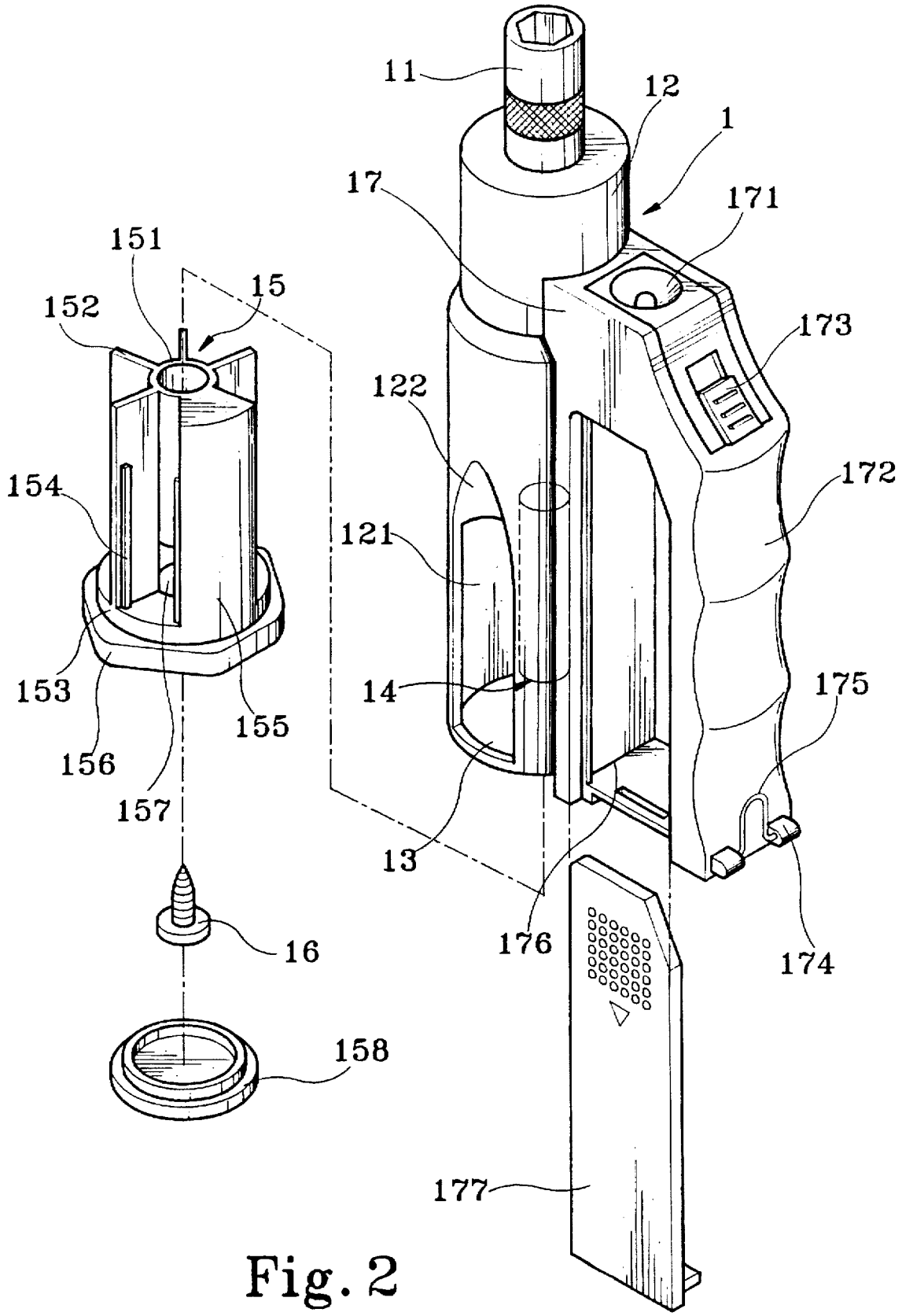
FIG. 2 is a schematic exploded view of the present invention.

With reference to FIGS. 1 and 2, the improved driver structure according to the present invention essentially comprises a shell 1 provided with a tool portion 12 for mounting a tool connecting portion 11. A turning mechanism 111 is provided below the tool connecting portion 11. A switch 112 on the turning mechanism 111 extends through a recessed hole 123 formed at an upper rim of the tool portion 12. The interior of the tool portion 12 is provided with an action groove 13 supporting a shaft post 14 therein, which is in turn pivotally connected to a swivel shaft 15. The center of the swivel shaft 15 is provided with a sleeve 151 with a plurality of partition plates 152 radially spaced apart on its outer side. The partition plates 152 are connected at their bottom to a base disk 153. A retain strip 154 is projectingly disposed at either side of each partition plate 152 such that the retain strips 154 may secure a drive bit (see FIG. 4) placed on the swivel shaft 15. A cover plate 155 is mounted on one of the partition plates 152. When not in use, the cover plate 155 on the swivel shaft 15 may be turned to close the opening 121 of the tool portion 12 to prevent the drive bit from falling out. A curve plane 122 extends along the opening 121 to facilitate the user from pushing out the drive bit. A swivel plate 156 extends from the bottom side of the base disk 154.

The swivel plate 156 may be rotated to turn the swivel shaft 15. A through hole 157 is formed at a bottom side of the swivel plate 156 for communicating with the sleeve 151. The through hole 157 further allows passage of a screw 16 therethrough to engage with the inner threads (not shown) of the shaft post 14. A cap 158 is further provided at the bottom side of the through hole 157 to seal it. A lighting portion 17 is supported on the tool portion 12. A light source 171 (such as a light bulb or other similar element) is provided at an upper rim of the lighting portion 17 while an ergonomically designed handle portion 171 is provided at a lateral rim thereof. An upper rim of the handle portion 171 is provided with a power switch 173, and a pair of securing shaft sleeves 174. The ends of a retainer 175 are pivotally held in the securing shaft sleeves 174 at both sides. The retainer 175 allows connection with key rings or chains. The above-mentioned lighting portion 171 further has a battery slot 176 in its interior. A lid 177 may be provided to close the battery slot 176 so as to prevent the battery in the battery slot from falling out.

Figure 3:
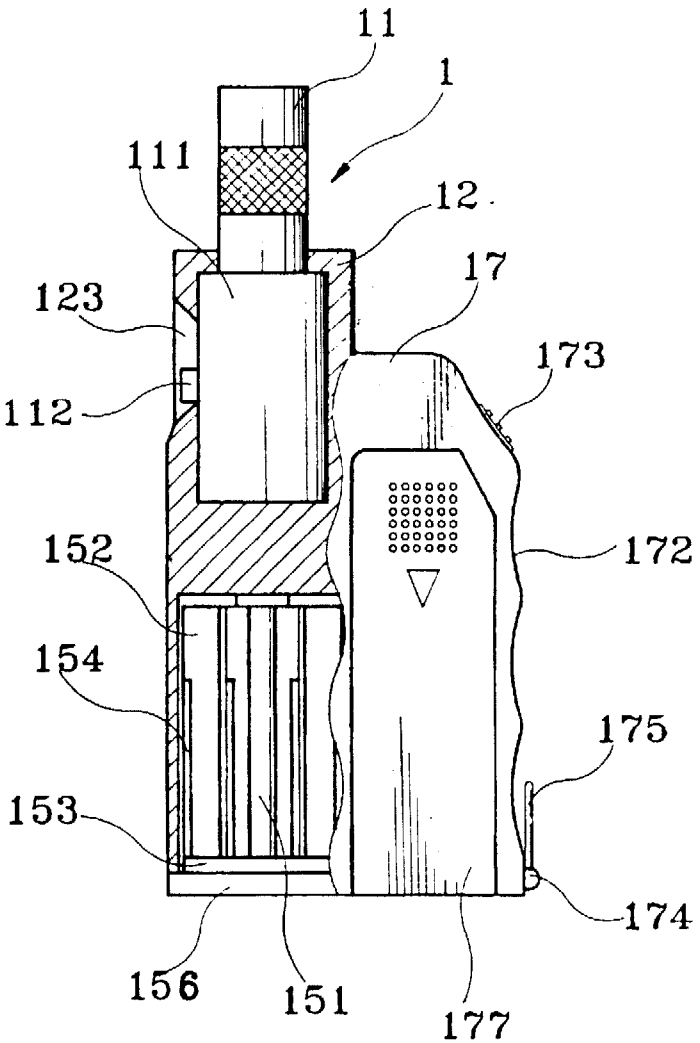
FIG. 3 is a schematic view illustrating action of the present invention.
Figure 4:
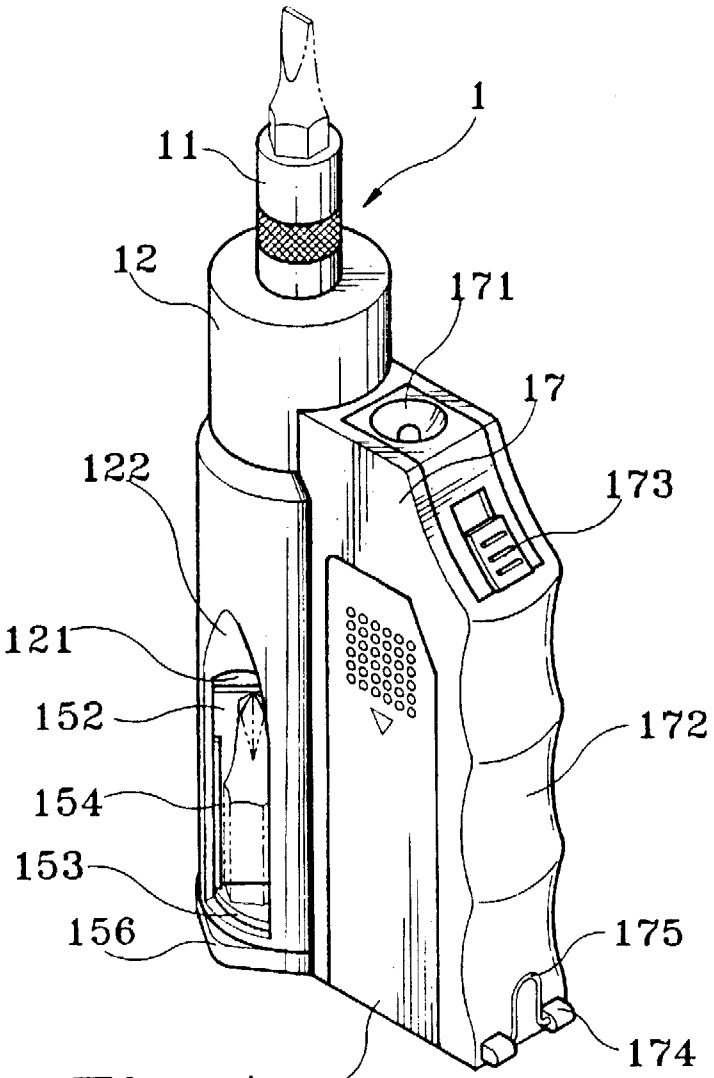
FIG. 4 is a schematic view of a preferred embodiment of the present invention.

As shown in FIGS. 3 and 4, when the power switch 173 of the lighting portion 17 is on, the light source 171 will light up, providing the user with adequate light under dim environments.

Furthermore, various drive bits may be placed on the swivel shaft 15 pivotally disposed in the tool portion 12 and secured by the retain strips 154 of the respective partition plates 152. When the user wishes to use any drive bit, he/she may just turn the swivel disk 156 at the bottom of the swivel shaft 15 which turns in the tool portion 12, such that the suitable drive bit may be exposed at the opening 121 of the tool portion 12. The drive bit is then pushed out and slides out along the curved plane 122 extending from the front end of the opening 121 for the user to pick up.

Furthermore, after the drive bit is removed, it is fitted onto the tool connecting portion 11 for use. Since the turning mechanism 111 is disposed below the tool portion 11, the user may selectively turn the drive bit in a clockwise or counterclockwise direction by means of the switch 112 on the turning mechanism 111.

The retainer 175 on the lateral rim of the lighting portion 17 further allows the user to fasten a key ring or chain thereto to facilitate carrying.

In summary, the improved driver structure according to the present invention provides a convenient driving tool which may also provide a light source at night.

Although the present invention has been illustrated and described with reference to the preferred embodiment thereof, it should be understood that it is in no way limited to the details of such embodiment but is capable of numerous modifications within the scope of the appended claims.

I claim:

1. An improved driver structure, comprising a driver shell comprising a tool portion for mounting a tool connecting portion, and a lighting portion with a light source, wherein said tool portion accommodates therein an action groove for accommodating a swivel shaft, a shaft post for pivotally connecting said swivel shaft being disposed in said groove, said action groove being inserted through a sleeve of said swivel shaft, said sleeve having thereon a plurality of partition plates which are connected to a base disk below, a drive bit being disposed between two adjacent partition plates, each of said partition plates being provided with a retain strip at either side for securing a drive bit, and one of said partition plates being covered by a cover plate, a swivel plate being disposed below said base disk, said swivel plate having a through hole communicating with said sleeve such that a screw may pass through said through hole to engage with the inner threads of said shaft post to enable said swivel shaft to be pivotally mounted on said shaft post, said through hole being closed by a cap, and said tool portion being provided with an opening with a curved plane extending from a front end therefrom; and said lighting portion has a handle portion at a lateral rim thereof, said handle portion being provided a securing sleeve means for pivotally connecting a retainer; whereby by means of turning said swivel shaft, the drive bit may be turned to said opening and pushed along said curved plane extending from said front end of said opening; and said light source of said lighting portion supported on said tool portion provides a lighting function.

2. An improved driver structure as claimed in claim 1, wherein a turning mechanism is disposed below said tool connecting portion, a switch for controlling said turning mechanism being disposed on said turning mechanism, said switch extending through a recessed hole at an upper rim of said tool portion.

* * * * *